US010315323B2

(12) United States Patent
Nicholas et al.

(10) Patent No.: US 10,315,323 B2
(45) Date of Patent: Jun. 11, 2019

(54) RAZOR CARTRIDGE WITH A PRINTED LUBRICATION CONTROL MEMBER

(71) Applicant: The Gillette Company, Boston, MA (US)

(72) Inventors: Andrew Charles Nicholas, Winchester, MA (US); Jeffrey Richard Holley, Scituate, MA (US); Matthew Richard Allen, Mason, OH (US); Marco Fontecchio, Framingham, MA (US); Shawn Justin Goldstein, Boston, MA (US)

(73) Assignee: The Gillette Company LLC, Boston, MA (US)

( * ) Notice: Subject to any disclaimer, the term of this patent is extended or adjusted under 35 U.S.C. 154(b) by 80 days.

(21) Appl. No.: 14/964,626

(22) Filed: Dec. 10, 2015

(65) Prior Publication Data

US 2016/0199990 A1 Jul. 14, 2016

Related U.S. Application Data

(60) Provisional application No. 62/100,999, filed on Jan. 8, 2015.

(51) Int. Cl.
*B26B 21/44* (2006.01)

(52) U.S. Cl.
CPC ..... *B26B 21/443* (2013.01)

(58) Field of Classification Search
CPC ..... B26B 21/443; B26B 21/222; B26B 21/60; B26B 21/14; B26B 21/22; B26B 21/4025; B26B 21/4018; B26B 21/4087
See application file for complete search history.

(56) References Cited

U.S. PATENT DOCUMENTS

| | | | | |
|---|---|---|---|---|
| 4,211,006 | A | 7/1980 | Halaby et al. | |
| 4,503,111 | A * | 3/1985 | Jaeger | B41M 5/5254 101/466 |
| 4,872,263 | A * | 10/1989 | Etheredge, III | B26B 21/443 30/41 |
| 5,630,275 | A | 5/1997 | Wexler | |
| 5,818,604 | A | 10/1998 | Delabastita et al. | |
| 5,915,791 | A | 6/1999 | Yin et al. | |
| 6,161,287 | A | 12/2000 | Swanson et al. | |

(Continued)

OTHER PUBLICATIONS

3D Polymer Printing with Desktop Inkjet Technology, Bleech, Karsten S. et al., Apr. 30, 2009, e.g., p. 8, Introduction, https://web.wpi.edu/Pubs/E-project/Available/E-project-043009-162846/unrestricted/FinalMQP.pdf.*

(Continued)

*Primary Examiner* — Kenneth E Peterson
(74) *Attorney, Agent, or Firm* — Kevin C. Johnson

(57) ABSTRACT

A razor cartridge including a guard at a front portion of the cartridge, a cap at a back portion of the cartridge, at least one blade positioned between the guard and the cap, a top surface and an opposing bottom surface, and a lubricating member positioned in the cartridge at the top surface. The lubricating member has a visible surface with a visible surface area. The visible surface includes a printed lubrication control structure on the visible surface of the lubricating member. The printed lubrication control structure is formed from a UV curable ink and covers a portion of the visible surface area creating a covered portion and an open portion.

8 Claims, 8 Drawing Sheets

(56) References Cited

U.S. PATENT DOCUMENTS 6,298,558 B1 * 10/2001 Tseng ..... B26B 21/443 30/41
6,923,115 B1 8/2005 Litscher et al.
7,126,724 B2 10/2006 McCrea et al.
7,152,969 B2 * 12/2006 Hintermann ..... B41J 2/15 347/102
7,581,318 B2 * 9/2009 Coffin ..... B26B 21/443 30/41
8,011,299 B2 * 9/2011 Vosahlo ..... B41J 11/002 101/424.1
8,104,887 B2 1/2012 Albrecht et al.
8,142,860 B2 * 3/2012 Vanmaele ..... B29C 67/0055 427/514
8,418,608 B2 4/2013 Preckel
8,526,056 B2 * 9/2013 Gargir ..... B41J 11/002 347/101
9,314,953 B2 4/2016 Lauer et al.
2002/0000041 A1 1/2002 Doroodian-Shoja
2003/0184633 A1 * 10/2003 Vanhooydonck ..... B41J 11/002 347/102
2004/0181943 A1 9/2004 Kwiecien
2005/0094212 A1 5/2005 Asai et al.
2005/0246898 A1 11/2005 Gilder
2008/0034590 A1 2/2008 Prudden et al.
2009/0223057 A1 9/2009 Coope-Epstein et al.
2010/0096386 A1 * 4/2010 Uptergrove ..... B41M 5/0017 220/62.11
2010/0225940 A1 * 9/2010 Gargir ..... B41J 11/002 358/1.9
2011/0126413 A1 * 6/2011 Szczepanowski .. B26B 21/4087 30/41
2012/0000047 A1 1/2012 Jones
2012/0000074 A1 * 1/2012 PazosSchroeder ..... B26B 21/40 30/34.05
2012/0090179 A1 * 4/2012 Stephens ..... B26B 21/443 30/34.05
2014/0310960 A1 10/2014 Ariyanayagam et al.
2014/0323374 A1 10/2014 Stephens et al.
2016/0136967 A1 5/2016 Allen et al.
2016/0136969 A1 5/2016 Allen et al.
2016/0199990 A1 7/2016 Nicholas et al.
2016/0199991 A1 7/2016 Nicholas
2016/0199992 A1 7/2016 Nicholas et al.
2016/0207211 A1 7/2016 Madeira et al.

OTHER PUBLICATIONS

PCT Search Report with Written Opinion in corresponding international application PCT/US2016/012472 dated Apr. 25, 2016.
U.S. Appl. No. 14/964,636, filed Dec. 10, 2015, Andrew Charles Nicholas.
U.S. Appl. No. 14/964,641, filed Dec. 10, 2015, Andrew Charles Nicholas et al.
U.S. Appl. No. 12/629,249, filed Dec. 2, 2009, Andrew Anthony Szczepanowski et al.
U.S. Appl. No. 12/828,401, filed Jul. 1, 2010, Marta Pazos Schroeder.

* cited by examiner

RAZOR CARTRIDGE WITH A PRINTED LUBRICATION CONTROL MEMBER

FIELD OF THE INVENTION

The invention relates to razors, and more particularly to razor cartridges having lubricating members with printed portions.

BACKGROUND OF THE INVENTION

The use of shaving aids on razor blades to provide lubrication benefits during the shave is known. See e.g., U.S. Pat. Nos. 7,121,754; 6,298,558; 5,711,076; 5,134,775; 6,301,785; and U.S. Patent Publ. Nos. 2009/0223057 and 2006/0225285. These shaving aids are also commonly referred to as lubrication strips or lubrication members. These types of lubrication strips have been used for years in the shaving industry. The strips are typically extruded making them very cost effective. They may also be extruded in two or more colors to provide both a visual and a functional benefit. The visual benefits being limited by the capabilities of the extruder.

Different structures for delivering lubrication benefits have also been attempted. One such structure is a reservoir that is attached to the razor cartridge. The reservoir contains a lubricant in dry form. The skin engaging surface of the reservoir includes a plurality of apertures. The apertures allow water to enter the reservoir. Upon entering the reservoir, the water interacts with the dry lubricant to create a lubricant which flows out from the reservoir through the apertures to provide a lubricant to the user during shaving. The amount of lubricant delivered to the user during the shave can be determined by the size of the apertures in the reservoir. While such reservoirs do provide the ability to better control the amount of lubricant delivered during the shave, they present the problem of high cost and assembly disadvantages compared to typical lubrication strips.

It is an object of the present invention to provide a lubrication member with the ability to control or meter the amount of lubricant delivered from the lubricating member to the user during shaving without the high cost and assembly disadvantages associated with a reservoir.

SUMMARY OF THE INVENTION

One aspect of this invention relates to a razor cartridge. The razor cartridge comprises a guard at a front portion of the cartridge, a cap at a back portion of the cartridge, at least one blade positioned between the guard and the cap, a top surface, and a lubricating member positioned at the top surface. The lubricating member has a visible surface and the visible surface has a visible surface area. A printed lubrication control structure is on the visible surface of the lubricating member. The printed lubrication control structure comprises a UV curable ink and covers a portion of the visible surface area creating a covered portion and an open portion. Preferably, the open portion comprises a plurality of openings within the lubrication control structure. The openings are spaced apart from one another by the covered portion.

The lubricating member within the openings is directly exposed to a user's skin during shaving. The lubricating member may be positioned on the cap, on the guard, or be in the form of a ring surrounding the blade.

The printed lubrication control structure comprises a plurality of printed droplets. The printed droplets adjacent to one another may be spaced apart from one another or may overlap each other.

The covered portion may cover from about 3% to about 70% of the visible surface area. The covered portion may cover from about 5% to about 40% of the visible surface area. The covered portion may cover from about 10% to about 30% of the visible surface area.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
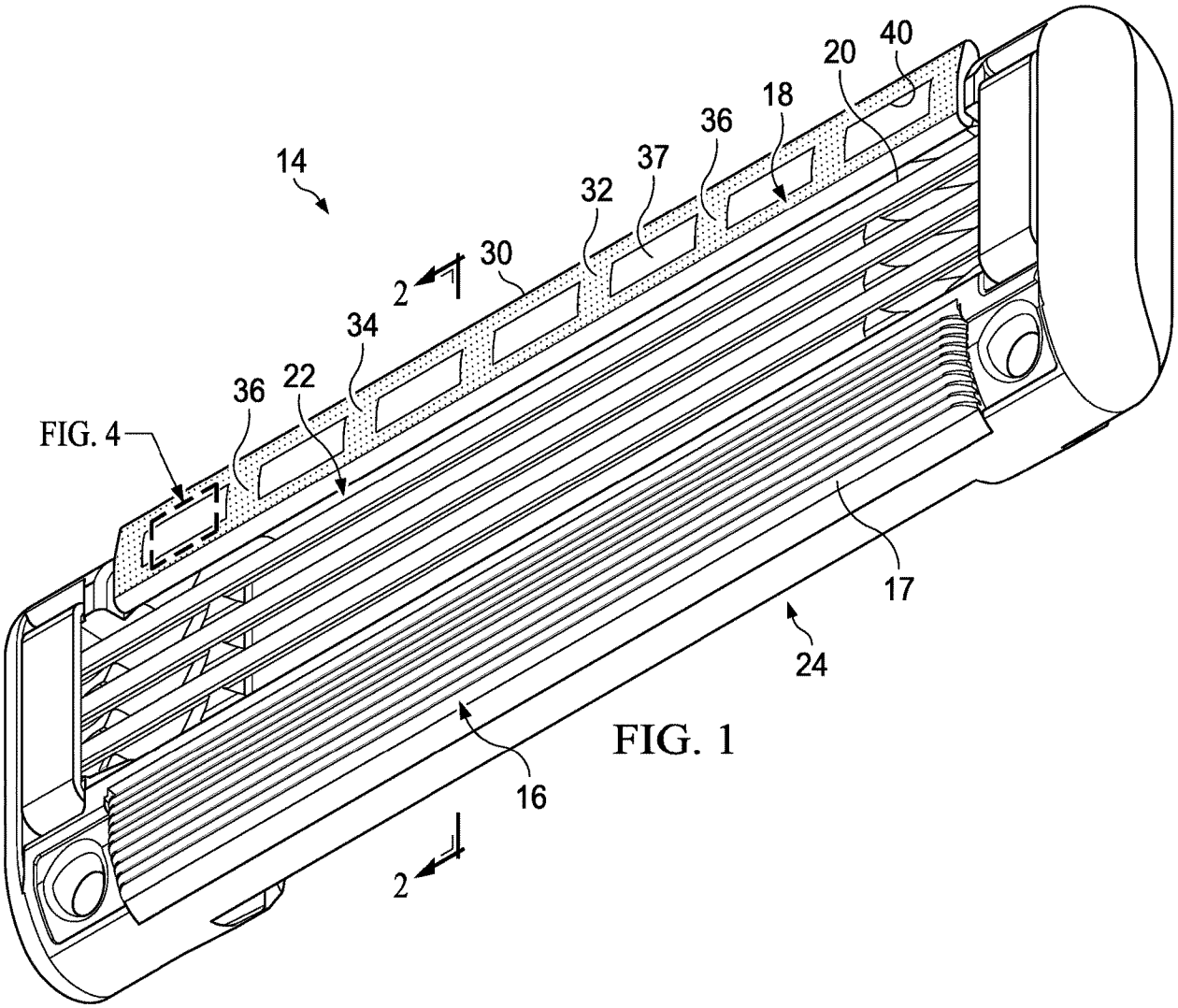
FIG. 1 is a perspective view of a razor cartridge of the present invention.

Referring to FIGS. 1-4B, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. A lubricating member 30 is positioned on the top surface 22 of the cartridge 14. Lubricating member 30 has a visible or top surface 32. The visible surface 32 has a visible surface area that can be seen by a user.

The guard 16 may include one or more elongated flexible protrusions 17 to engage a user's skin. The flexible protrusions 17 include flexible fins generally parallel to the one or more elongated blades 20. In another embodiment, the flexible fins have at least one portion which is not generally parallel to the one or more elongated edges. Non-limiting examples of suitable guards include those used in current razor blades and include those disclosed in U.S. Pat. Nos. 7,607,230 and 7,024,776; (disclosing elastomeric/flexible fin bars) and U.S. Publ. Nos. 2008/0034590 (disclosing curved guard fins) and 2009/0049695A1 (disclosing an elastomeric guard having a guard forming at least one passage extending between an upper surface and a lower surface).

The lubricating member 30 along with guard 16, cap 18, and blades 20 form the skin engaging portion of the cartridge 14. The lubricating member 30 is preferably locked in (via adhesive, a fitment, or melt bonding) an opening or on a plate or other surface of the cartridge 14.

Figure 2:
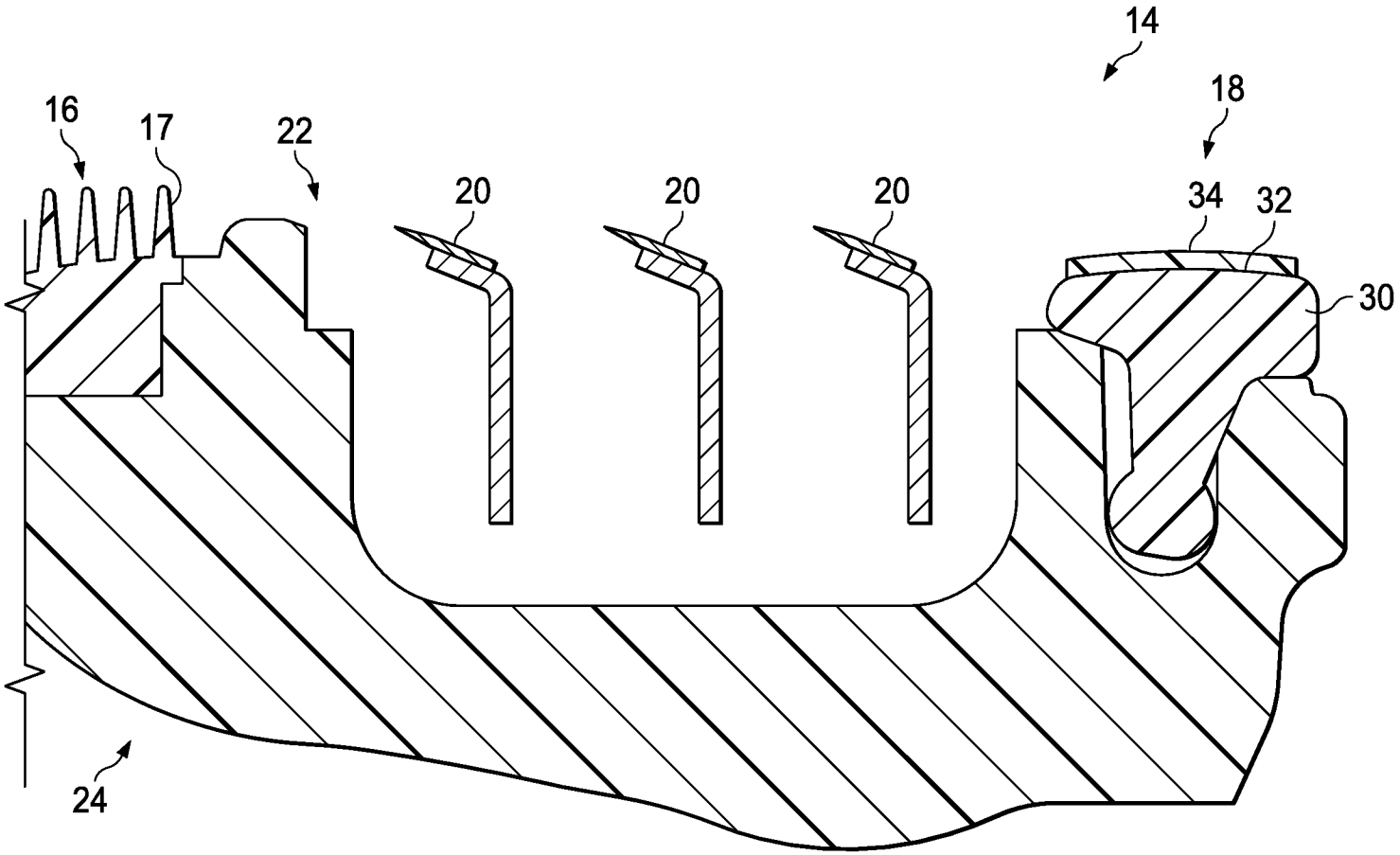
FIG. 2 is a sectional view taken along line 2-2 of FIG. 1.
Figure 3:
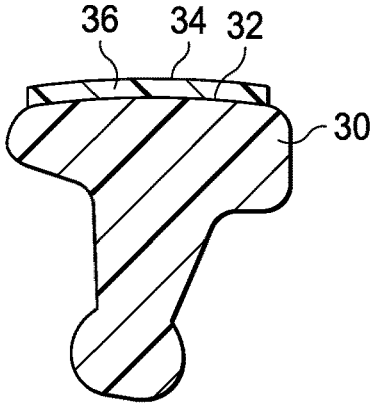
FIG. 3 is a side elevation view of a lubricating member of the present invention.

The lubricating member 30 is located on the cartridge such that the lubricating member 30 contacts or engages the skin during the hair removal process, forward and/or aft of the blades and/or along the sides of the cartridge between the forward and aft portions. A feature "forward" of the one or more elongated blade edges, for example, is positioned so that the surface to be treated by the cartridge or hair removal device encounters the feature before it encounters the elongated edges. A feature "aft" of the elongated blade edge(s) is positioned so that the surface to be treated by the cartridge or hair removal device encounters the feature after it encounters the elongated blade edges. In FIGS. 1-2 the lubricating member 30 is positioned aft of the blades 20 on the cap 18. Where more than one lubricating member is provided on the cartridge, the lubricating members can be the same or different. By different, meaning having a different size, a different shape, a different composition, and/or a different function.

In one embodiment, the lubricating member 30 comprises a solid polymeric matrix comprising a water-soluble polymer material having a melting point of from about 150° C. to about 250° C. and optionally a water-insoluble polymer material. In one embodiment, the matrix comprises a water soluble polymer comprising at least one of a polyethylene oxide, polyvinyl pyrrolidone, polyacrylamide, polyhydroxymethacrylate, polyvinyl imidazoline, polyethylene glycol, polyvinyl alcohol, polyhydroxyethymethacrylate, silicone polymers, and mixtures thereof. In one embodiment, said water soluble polymer is selected from the group consisting of polyethylene oxide, polyethylene glycol, and a mixture thereof.

The lubricating member 30 may comprise other ingredients commonly found in commercially available lubricating members, such as those used on razor cartridges by Gillette, Schick or BIC. Non-limiting examples of such lubricating members include those disclosed in U.S. Pat. Nos. 6,301,785; 6,442,839; 6,298,558; 6,302,785, and U.S. Patent Publ. Nos. 2008/060201 and 2009/0223057. The lubricating member may also comprise an ingredient selected from the group consisting of polyethylene oxide, polyvinyl pyrrolidone, polyacrylamide, hydroxypropyl cellulose, polyvinyl imidazoline, polyethylene glycol, poly vinyl alcohol, polyhydroxyethylmethacrylate, silicone copolymers, sucrose stearate, vitamin E, soaps, surfactants, panthenol, aloe, plasticizers, such as polyethylene glycol; beard softeners; additional lubricants, such as silicone oil, Teflon® polytetrafluoroethylene powders (manufactured by DuPont), and waxes; essential oils such as menthol, camphor, eugenol, eucalyptol, safrol and methyl salicylate; tackifiers such as Hercules Regalrez 1094 and 1126; non-volatile cooling agents, inclusion complexes of skin-soothing agents with cyclodextrins; fragrances; antipruritic/counterirritant materials; antimicrobial/keratolytic materials such as Resorcinol; anti-inflammatory agents such as Candilla wax and glycyrrhetinic acid; astringents such as zinc sulfate; surfactants such as pluronic and iconol materials; compatibilizers such as styrene-b-EO copolymers; mineral oil, polycaprolactone (PCL), and combinations thereof.

The water-soluble polymer will preferably comprise at least 50%, more preferably at least 60%, by weight of the skin engaging member, up to about 99%, or up to about 90% of the matrix. The more preferred water soluble polymers are the polyethylene oxides generally known as POLYOX (available from Dow or ALKOX (available from Meisei Chemical Works, Kyoto, Japan). These polyethylene oxides will preferably have mol·wt·s of about 100,000 to 6 million, most preferably about 300,000 to 5 million. The most preferred polyethylene oxide comprises a blend of about 40 to 80% of polyethylene oxide having an average mol·wt. of about 5 million (e.g. POLYOX COAGULANT) and about 60 to 20% of polyethylene oxide having an average mol·wt. of about 300,000 (e.g. POLYOX WSR-N-750). The polyethylene oxide blend may also advantageously contain up to about 10% by weight of a low mol·wt. (i.e. MW<10,000) polyethylene glycol such as PEG-100.

The matrix may comprise from about 0.5% to about 50%, preferably from about 1% to about 20%, polycaprolactone (preferably mol·wt. of 30,000 to 60,000 daltons). See U.S. Pat. No. 6,302,785.

The lubricating member may contain other conventional ingredients, such as low mol·wt. water-soluble release enhancing agents such as polyethylene glycol (MW<10,000, e.g., 1-10% by weight PEG-100), water-swellable release enhancing agents such as cross-linked polyacrylics (e.g., 2-7% by weight), colorants, antioxidants, preservatives, vitamin E, aloe, cooling agents, essential oils, beard softeners, astringents, medicinal agents, etc.

The matrix can further comprise a water-insoluble polymer in which the water-soluble polymer is dispersed. Preferably, at a level of from about 0% to about 50%, more preferably about 5% to about 40%, and most preferably about 15% to about 35% by weight of the skin engaging member is a water-insoluble polymer. Suitable water-insoluble polymers which can be used include polyethylene (PE), polypropylene, polystyrene (PS), butadiene-styrene copolymer (e.g. medium and high impact polystyrene), polyacetal, acrylonitrile-butadiene-styrene copolymer, ethylene vinyl acetate copolymer, polyurethane, and blends thereof such as polypropylene/polystyrene blend or polystyrene/impact polystyrene blend.

One preferred water-insoluble polymer is polystyrene, preferably a general purpose polystyrene or a high impact polystyrene such as Styrenics 5410 from Ineos (i.e. polystyrene-butadiene), such as BASF 495F KG21. The water-insoluble polymer provides mechanical strength to the lubricating member for production and during use.

The lubricating member may be made by extrusion or another high temperature processing, such as injection molding, compacting, ultrasonic or radio frequency sintering, and slot coating.

The blended components of the lubricating member may be extruded through a Haake System 90, ¾ inch diameter extruder with a barrel pressure of about 1000-2000 psi, a rotor speed of about 10 to 50 rpm, and a temperature of about 150°-185° C. and a die temperature of about 170°-185° C. Alternatively, a 1¼ inch single screw extruder may be employed with a processing temperature of 175°-200° C., preferably 185°-190° C., a screw speed of 20 to 50 rpm, preferably 25 to 35 rpm, and an extrusion pressure of 1800 to 5000 psi, preferably 2000 to 3500 psi. The extruded strip is air cooled to about 25° C. To injection mold the strips it is preferred to first extrude the powder blend into pellets.

This can be done on a 1¼ or 1½ inch single screw extruder at a temperature of 120°-180° C., preferably 140°-150° C., with a screw speed of 20 to 100 rpm, preferably 45 to 70 rpm. The pellets are then molded in either a single material molding or multi-material molding machine, which may be single cavity or multi-cavity, optionally equipped with a hot-runner system. The process temperature can be from 165° to 250° C., preferably from 180° to 225° C. The injection pressure should be sufficient to fill the part completely without flashing. Depending on the cavity size, configuration, and quantity, the injection pressure can range from 300 to 2500 psi. The cycle time is dependent on the same parameters and can range from 3 to 30 seconds, with the optimum generally being about 6 to 15 seconds. In one embodiment, one or more feeds can be preheated or they can be fed in at ambient temperature.

In one embodiment, the lubricating member is attached to the cartridge via a carrier. The lubricating member can be a molded soap formulation and can be integrally formed (meaning they are formed in the same process, such as where they are both cast together in a single mold) with the carrier, or not integrally formed (meaning the lubricating member can be attached to the carrier via a mechanical attachment, such as where the lubricating member is molded or otherwise fitted around a retaining portion of the carrier, or bonded via adhesive or heat). Non-limiting examples of suitable lubricating members include the soap wings present on Venus Breeze® line of 2-in-1 razor, and/or the moisturizing solid on the Schick® Intuition® line of razors. In one embodiment, the lubricating member and carrier can resemble the shaving aids and shaving aid holders disclosed in U.S. Patent Publ. Nos. 2006/225285A and 2006/080837A, and/or U.S. Pat. No. 7,811,553.

The visible or top surface 32 of lubricating member 30 includes a printed lubrication control structure 34. The printed lubrication control structure 34 covers only a portion of the visible surface area of the visible surface 32 of lubricating member 30.

The printed lubrication control structure 34 on the visible or top surface 32 of the lubricating member 30 covers a portion of the visible surface area creating a covered portion 36 and an open portion 37. The open portion 37 is shown having a plurality of openings 40 within the lubrication control structure 34. The openings 40 are spaced apart from one another by the covered portion 36. The openings 40 of the visible surface 32 are free from printing leaving the visible surface 32 within the openings 40 exposed to the external environment and thus exposed to a user's skin during shaving. The covered portion 36 comprises a plurality of individual printed droplets 38.

During shaving openings 40 of lubricating member 30 are directly exposed to the shaving environment which includes water, shave preps and skin. This direct exposure to the shaving environment allows for the release of lubricant or soluble constituent from the lubricating member 30 a phenomenon typically referred to as leaching. This leaching from the very first shave is important to provide the desired lubrication benefits throughout the intended use of the cartridge 14, such as shown in FIG. 1. In contrast, if the visible surface was completely covered with no openings, the user would first need to wear through the printed ink to eventually expose the underlying lubricating member. In the absence of openings the benefits provided by the lubricating member would not be realized on the first or subsequent shaves until the printed covered portion was worn away to expose the underlying lubricating member.

The area of visible surface 32 covered by the covered portion 36 controls the amount of lubricant delivered to the user during the shave. A smaller area occupied or covered by covered portion 36 results in greater and faster delivery of lubricant to the user during the shave. A larger area covered occupied or covered by covered portion 36 results in less and slower delivery of lubricant to the user during the shave. In general, the more lubricious the lubricating member a greater amount of coverage by the printed lubrication control member is needed and the less lubricious the lubricating member a lesser amount of coverage by the printed lubrication control member is needed. The covered portion preferably covers from about 3% to about 70% of the visible surface area; more preferably covers from about 5% to about 40% of the visible surface area, and most preferably covers from about 10% to about 30% of the visible surface area.

Figure 4A:
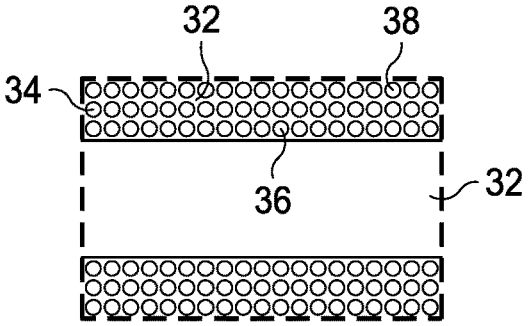
FIG. 4A is an enlarged view of a portion of the lubricating member shown in FIG. 1.

Referring now to FIG. 4A, the covered portion 36 of the printed lubrication control structure 34 on the visible surface 32 comprises a plurality of printed droplets 38. The size of the printed droplets 38 may be consistent throughout the printed lubrication control structure 34. The size of the printed droplets 38 may vary throughout the printed lubrication control structure.

Adjacent printed droplets 38 are spaced apart from one another leaving visible surface 32 uncovered within covered portion 36. To the user the covered portion appears as solid printing given the close proximity of adjacent printed droplets 38. The visible surface 32 within covered portion 36 adds to the overall percentage of visible surface area that is uncovered even though not visible to the naked eye.

Figure 4B:
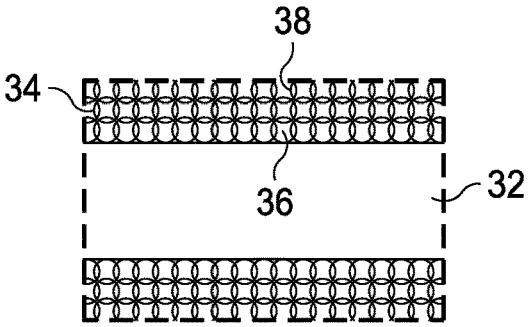
FIG. 4B is an enlarged view of a portion of the lubricating member shown in FIG. 1.

Referring now to FIG. 4B, the covered portion 36 of the printed lubrication control structure 34 on the visible surface 32 comprises a plurality of printed droplets 38. The size of the printed droplets 38 may be consistent or vary in size.

Adjacent printed droplets 38 overlap one another leaving no visible surface 32 uncovered within covered portion 36. The covered portion 36 is a continuous printed surface forming a solid printing.

In other embodiments the covered portions of the printed lubrication control structure may comprise spaced apart adjacent droplets as shown in FIG. 4A or may comprise overlapping adjacent droplets as shown in FIG. 4B.

The printed droplets may be applied with suitable types of device including, but not limited to print heads, nozzles, and other types of material deposition devices. Any suitable type of print heads can be used including, but not limited to inkjet print heads. In certain embodiments, the deposition device is an ink jet print head. The print heads may be of a non-contacting, digital type of deposition device. By "non-contacting", it is meant that the print heads do not contact the surface to be printed. By "digital", it is meant that the print heads can apply droplets of ink only where needed such as to form a pattern in the form of words, figures (e.g., pictures), or designs.

Ink jet print heads will typically comprise multiple nozzles. The nozzles are generally aligned in rows and are configured to jet ink in a particular direction that is generally parallel to that of the other nozzles. The nozzles within each row on a print head can be aligned linearly. Alternatively, the nozzles may be in one or more rows that are oriented diagonally relative to the longer dimension (or length) of the print head. Both such arrangements of nozzles can be considered to be substantially linearly arrayed. The inkjet print heads can comprise any suitable number and arrangement of nozzles therein. One suitable inkjet print head contains approximately 360 nozzles per inch (per 2.54 cm).

The Xaar 1001 is an example of a suitable print head for use herein, and is available from Xaar of Cambridge, UK.

The droplets of ink can range in diameter from about 10 microns or less to about 200 microns, or more. The droplets of ink can be distributed in any suitable number over a given area. Typically, in ink jet printing, the ink droplets form a matrix in which the number of drops per inch (DPI) is specified in the direction of movement of the print head or article to be printed, and in a direction on the surface of the article perpendicular thereto. The application of ink droplets provided on the surface of the lubricating member to form a solid image can range from about 80, or less up to about 2,880 or more droplets per inch (DPI) in at least one direction.

The apparatus can comprise a printing apparatus with any suitable number, arrangement, and type of print heads. For example, the apparatus may comprise between 1-20, or more, print heads. The print heads may be arranged in a spaced apart relationship. Alternatively, one or more of the print heads may be positioned adjacent and in contact with another one of the print heads.

If there is more than one print head, the different print heads can print cyan, magenta, yellow, and black or any other combination of desired colors.

The ink of the present invention is preferably an ultraviolet (UV) curable ink. UV curable inks are generally monomer/oligomer based with photosensitive molecules that initiate a polymerization reaction (e.g. curing) when exposed to UV light. This reaction is near instantaneous once the ink lands on a substrate. The cross linking that occurs during curing provides a durable ink with good adhesion to the substrate.

Suitable types of UV curable ink that may be used include free radical and cationic. Both free radical and cationic UV inks are cured when exposed to UV light. When free radical inks are exposed to UV light a photoinitiator absorbs the UV light generating free radicals which react with double bonds causing chain reaction and polymerization. When cationic inks are exposed to UV light a photoinitiator absorbs the UV light generating a Lewis acid which reacts with epoxy groups resulting in polymerization.

Other types of UV curable inks may also be used. Examples of such UV curable inks include but are not limited to hybrid UV/water inks and hybrid UV/oil inks.

The high cure rates of UV curable inks translate into very high operating speeds. Thus, UV curable inks can be advantageously run on high-speed production equipment without having to allow for excessively large dryers, as would be necessary for other ink systems. The rapid cure rate also allows UV curable inks to be used to provide multiple layers in succession without having to move the substrate after each layer. This in turn allows for elevation, structuring, texturing, and colors to be easily incorporated.

Figure 5:
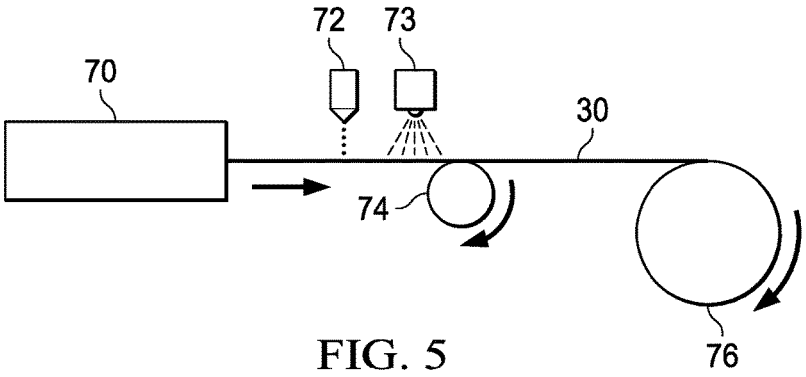
FIG. 5 is a side view of a printing process of the present invention.

Referring to FIG. 5, there is shown an extruder 70 extruding a lubricating member 30. Printing station 72 containing multiple print heads prints ink in the form of droplets 38 on lubricating member 30, such as shown in FIG. 4. A light unit 73 directs UV light toward lubricating member 30 to cure the ink. Lubricating member is supported by roller 74 until taken up by wind up roll 76.

Figure 6:
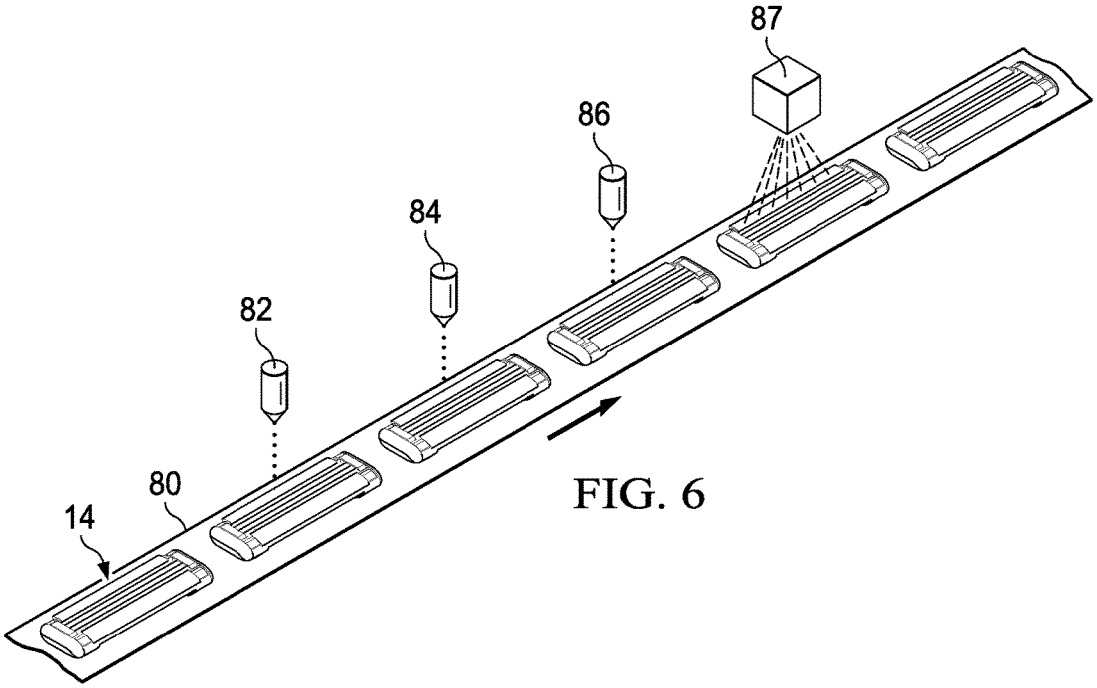
FIG. 6 is a side view of a printing process of the present invention.

Referring to FIG. 6, there is shown a web 80 carrying independent cartridges 14 such as shown in FIG. 1. Cartridges 14 pass under print stations 82, 84 and 86 which print ink in the form of droplets 38 on lubricating member 30 such as shown in FIG. 4. A light unit 87 directs UV light toward cartridge 14 to cure the ink. Cartridges 14 can then pass to the next processing station by web 80.

Other forms or techniques of printing may be used. However, ink jet printing of UV curable inks is preferred given the advantages associated with ink jet printing of UV curable inks. The UV curable ink is an ideal material for the lubrication control structure. Upon curing the UV curable ink forms a durable ink that does not easily erode during shaving maintaining its integrity after multiple shaves. This integrity maintenance provided by the UV curable ink allows the lubrication control structure to maintain a consistent flow of lubrication from the lubricating member through the lubrication control structure over multiple shaves.

Figure 7:
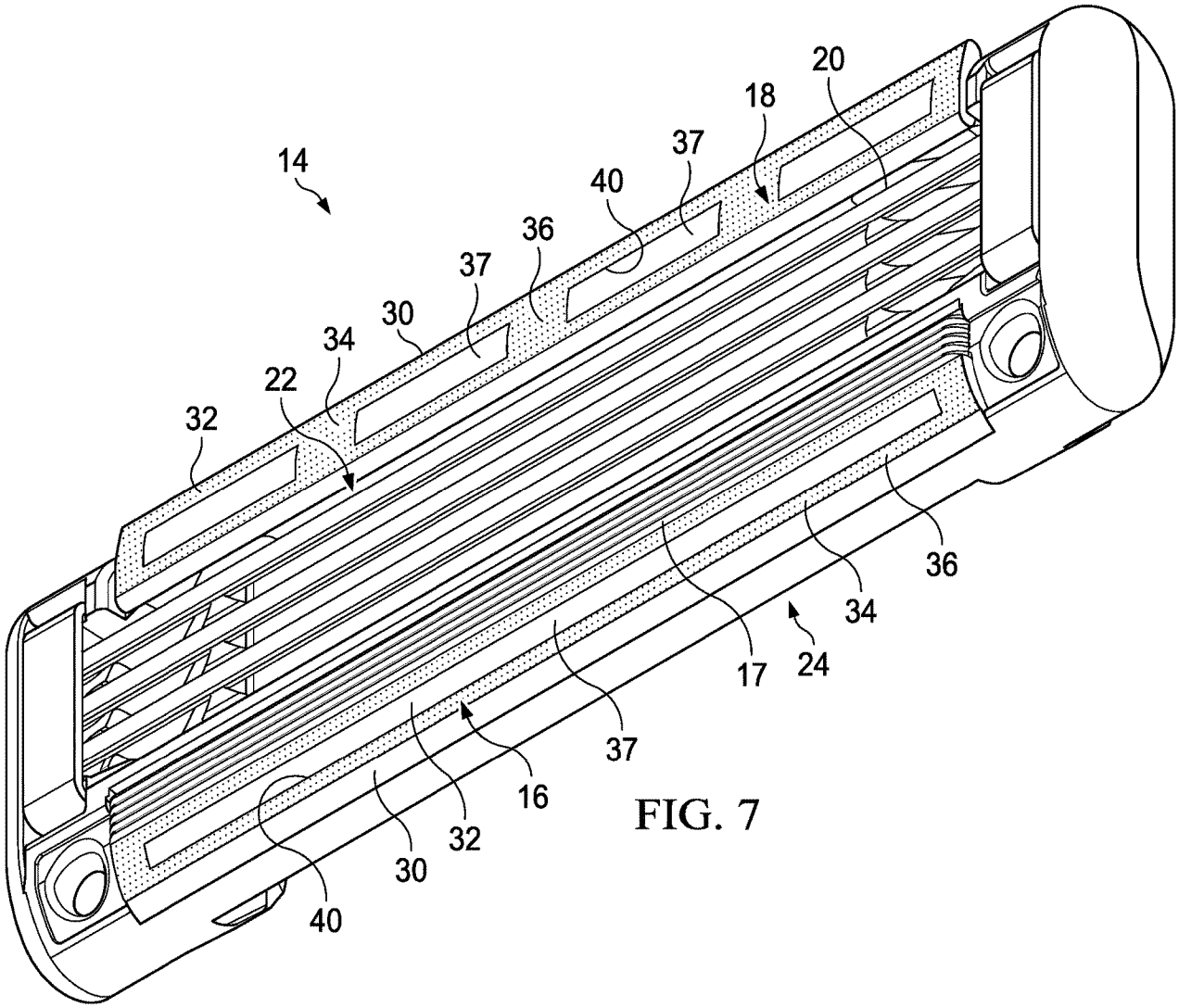
FIG. 7 is a perspective view of another razor cartridge of the present invention.

Referring to FIG. 7, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating members 30 are positioned on the top surface 22 of the cartridge 14. Lubricating members 30 each have a visible surface 32. The guard 16 includes flexible protrusions 17 in the form of flexible fins extending generally parallel to the one or more elongated blades 20.

The lubricating members 30 along with guard 16, cap 18 and blades 20 form skin engaging portions of the cartridge 14. The lubricating members 30 are located on the cartridge such that the lubricating members 30 contact or engage the skin during the hair removal process. The lubricating members 30 are positioned both forward and aft of the blades 20. The lubricating members 30 are positioned on the guard 16 and cap 18, respectively.

The visible surfaces 32 of lubricating members 30 include printed lubrication control structures 34. The printed lubrication control structures 34 comprise a UV curable ink covering a portion of the visible surface area of the visible surfaces 32 of lubricating members 30. The printed lubrication control structure 34 on the visible surfaces 32 of the lubricating members 30 cover a portion of the visible surface area creating a covered portion 36 and an open portion 37. The open portion 37 on lubricating member 30 positioned on the guard 16 comprises a single opening 40. The open portion 37 on the lubricating member 30 positioned on the cap 18 comprises a plurality of openings 40 within the lubrication control structure 34. The openings 40 are spaced apart from one another by the covered portion 36.

The open portion 37 is free from printing leaving the visible surface 32 within the open portion 37 exposed to the external environment and thus exposed to a user's skin during shaving. The covered portion 36 comprises a plurality of individual printed droplets 38 of UV curable ink.

The printed control structure 34 may comprise a plurality of individual printed droplets.

Figure 8:
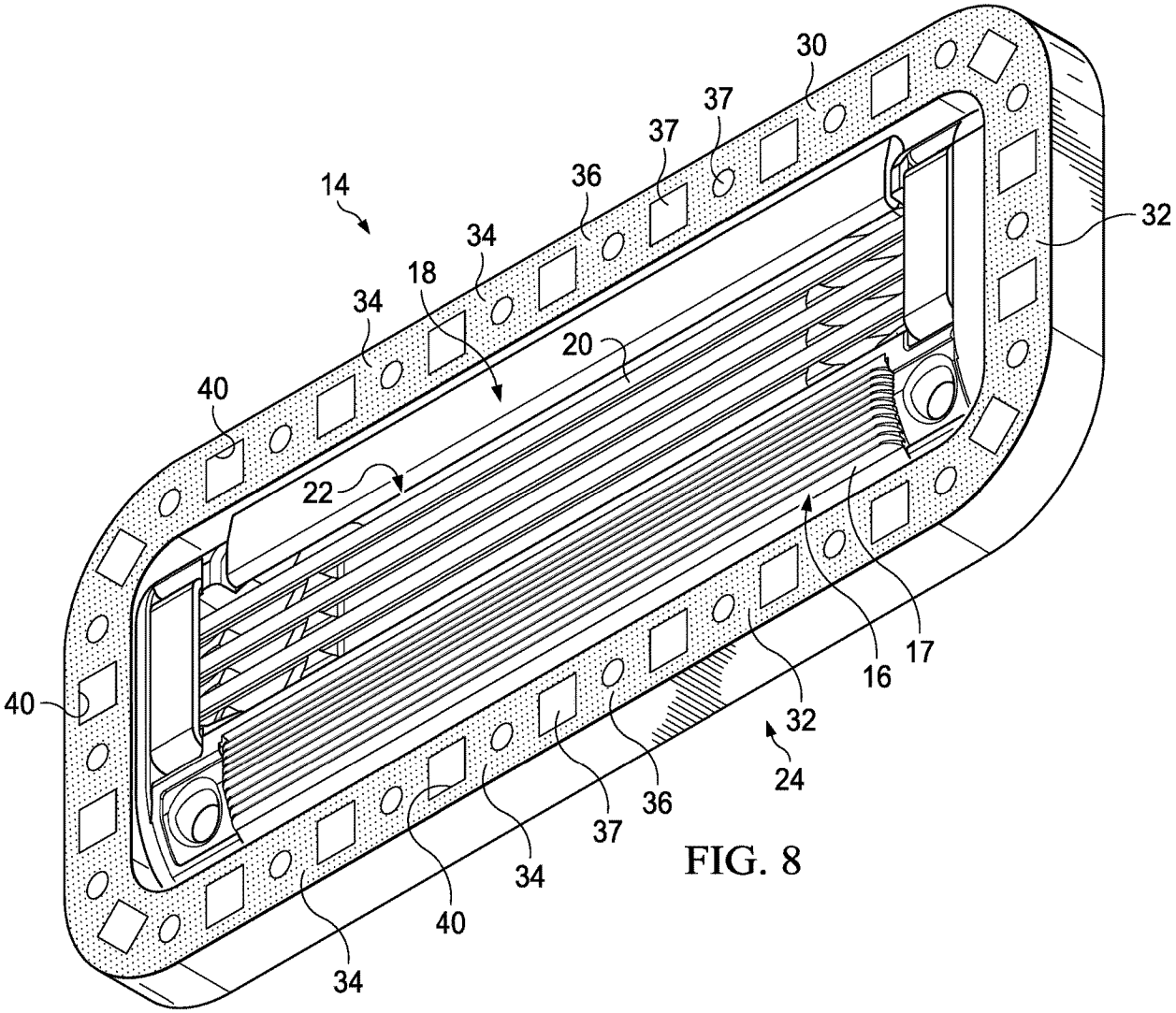
FIG. 8 is a perspective view of another razor cartridge of the present invention.

Referring to FIG. 8, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating member 30 is positioned on the top surface 22 of the cartridge 14. Lubricating member 30 has a visible surface 32. The guard 16 includes flexible protrusions 17 in the form of flexible fins extending generally parallel to the one or more elongated blades 20.

The lubricating member 30 along with the 16, cap 18 and blades 20 form the skin engaging portion of the cartridge 14. The lubricating member 30 is located on the cartridge such that the lubricating member 30 contacts or engages the skin during the hair removal process. The lubricating member 30 is the form of a ring surrounding blades 20.

The visible surface 32 of lubricating member 30 includes printed lubrication control structure 34. The printed lubrication control structure 34 comprises a UV curable ink covering a portion of the visible surface area of the visible surface 32 of lubricating member 30. The printed lubrication control structure 34 on the visible surface 32 of the lubricating member 30 covers a portion of the visible surface area creating a covered portion 36 and an open portion 37. The open portion 37 comprises a plurality of openings 40 within the lubrication control structure 34. The openings 40 are spaced apart from one another by the covered portion 36. The openings 40 of the visible surface 32 are free from printing leaving the visible surface 32 within the openings 40 exposed to the external environment and thus exposed to a user's skin during shaving. The covered portion 36 may comprise a plurality of individual printed droplets of UV curable ink.

Figure 9:
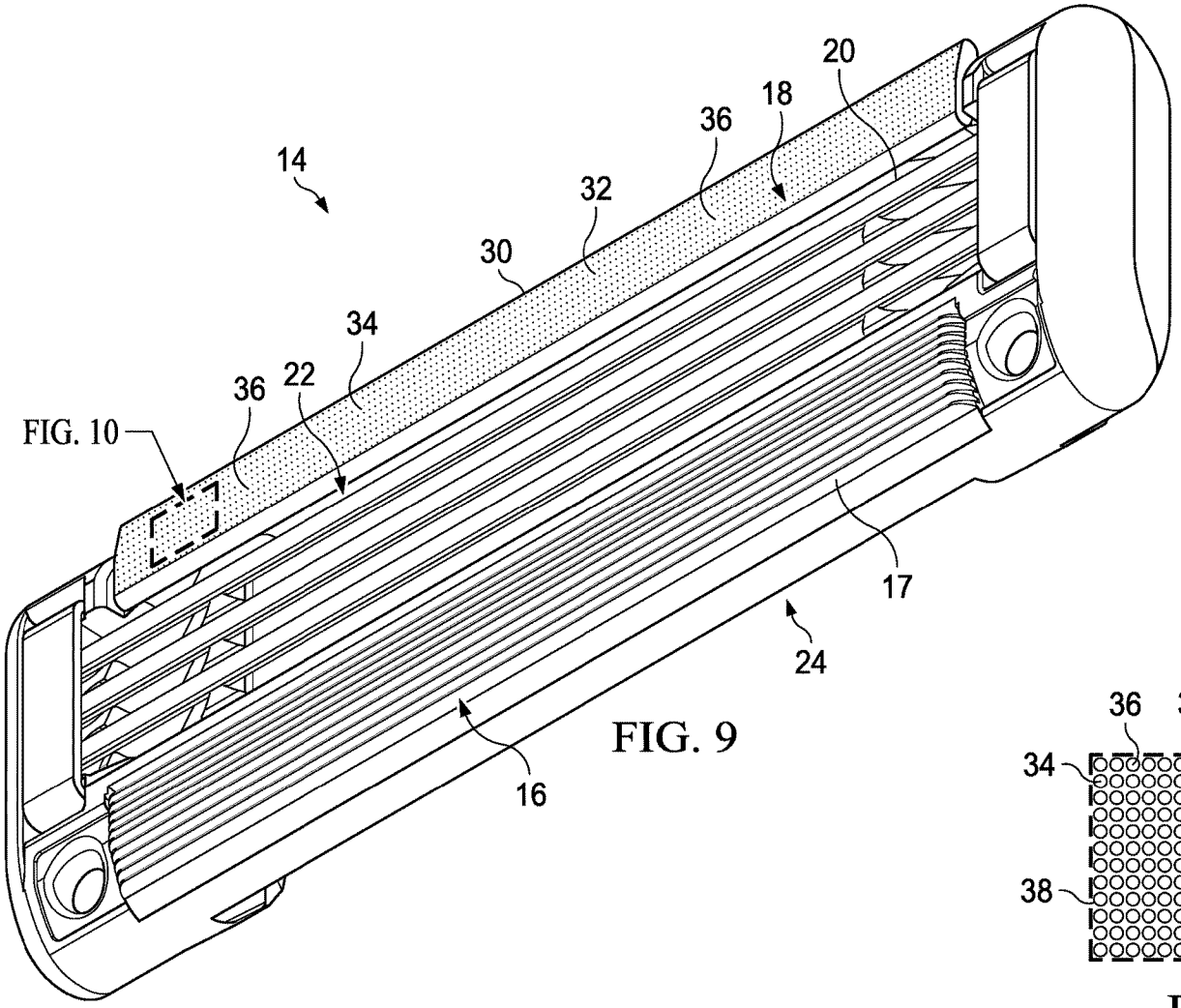
FIG. 9 is a perspective view of another razor cartridge of the present invention.
Figure 10:
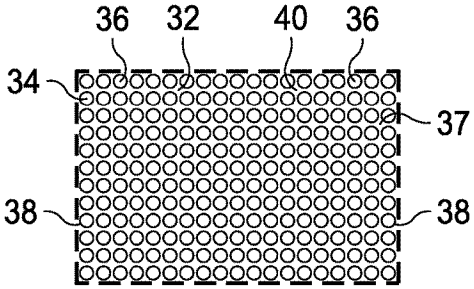
FIG. 10 is an enlarged view of a portion of the lubricating member shown in FIG. 9.

Referring to FIGS. 9 and 10, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating member 30 is positioned on the top surface 22 of the cartridge 14. Lubricating member 30 has a visible surface 32. The guard 16 includes flexible protrusions 17 in the form of flexible fins extending generally parallel to the one or more elongated blades 20.

Lubricating member 30 along with guard 16, cap 18 and blades 20 form skin engaging portions of the cartridge 14. The lubricating member 30 is located on the cartridge such that the lubricating member 30 contacts or engages the skin during the hair removal process. The lubricating member 30 is positioned aft of the blades 20. The lubricating member 30 is positioned on the cap 18.

The visible surface 32 of lubricating member 30 includes printed lubrication control structure 34. The printed lubrication control structure 34 comprises a UV curable ink on the visible surface 32 creating a covered portion 36 and an open portion 37. As viewed by the naked eye, the printed lubrication control structure 34 on the visible surface 32 of the lubricating member 30 appears as though the covered portion 36 covers the entire visible surface area 32. The covered portion 36 comprises a plurality of individual printed droplets 38 of UV curable ink. The open portion 37 of lubrication control structure 34 comprises a plurality of openings 40 between adjacent droplets 38. The open portion 37 is free from printing leaving the visible surface 32 within the open portion 37 exposed to the external environment and thus exposed to a user's skin during shaving.

Figure 11:
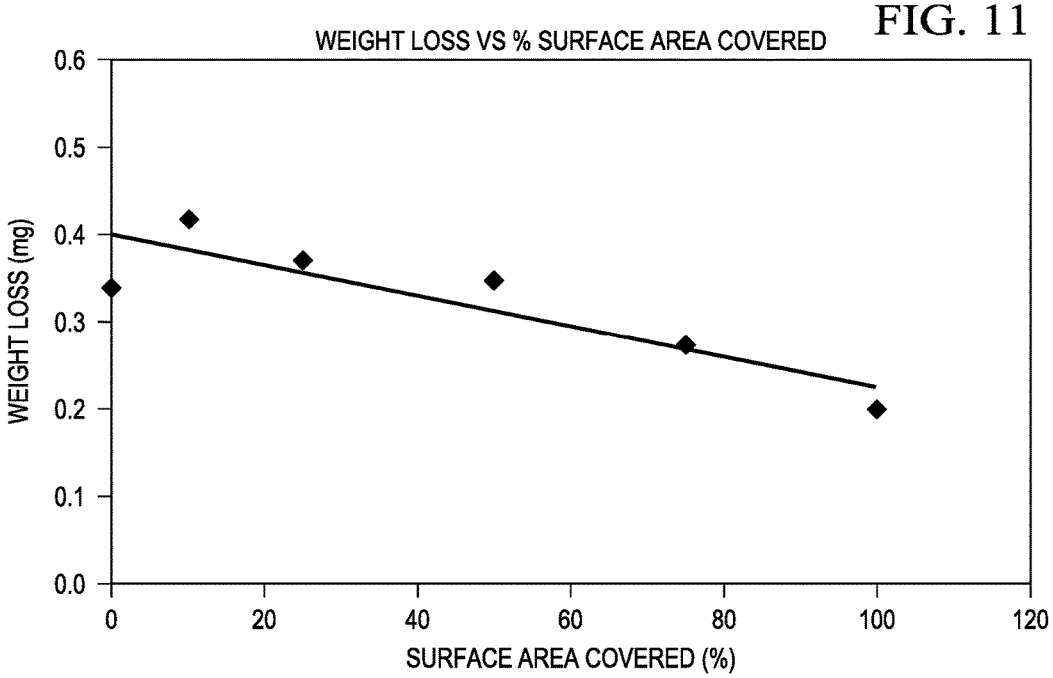
FIG. 11 is a graph showing lubricating member weight loss versus percent surface area covered by lubrication control member.

Several razor cartridges were tested to determine the effect the amount of printed lubrication control member had on weight loss of the lubricating member. Six different razor cartridges were tested. Each razor cartridge was of the same configuration and contained the same lubricating member formula. The only variable was the percentage of surface area of the lubricating member that was covered by the lubrication control member. Each razor cartridge was subjected to the same physical wear conditions where the cartridge was brought into contact with a wetted friction wheel that was rotated fifteen revolutions. The friction wheel had an exterior wool felt surface that was kept moist with water. The results of the experiment are provided in FIG. 11. As can be seen, there is a linear relationship between the weight loss the lubricating member experiences versus the percentage of the surface area that is covered with a lubricating control member. For this experiment, the lubricating members were printed with a lubricating control member similar to that shown in FIGS. 9 and 10 having open areas between the printed droplets.

Figure 12:
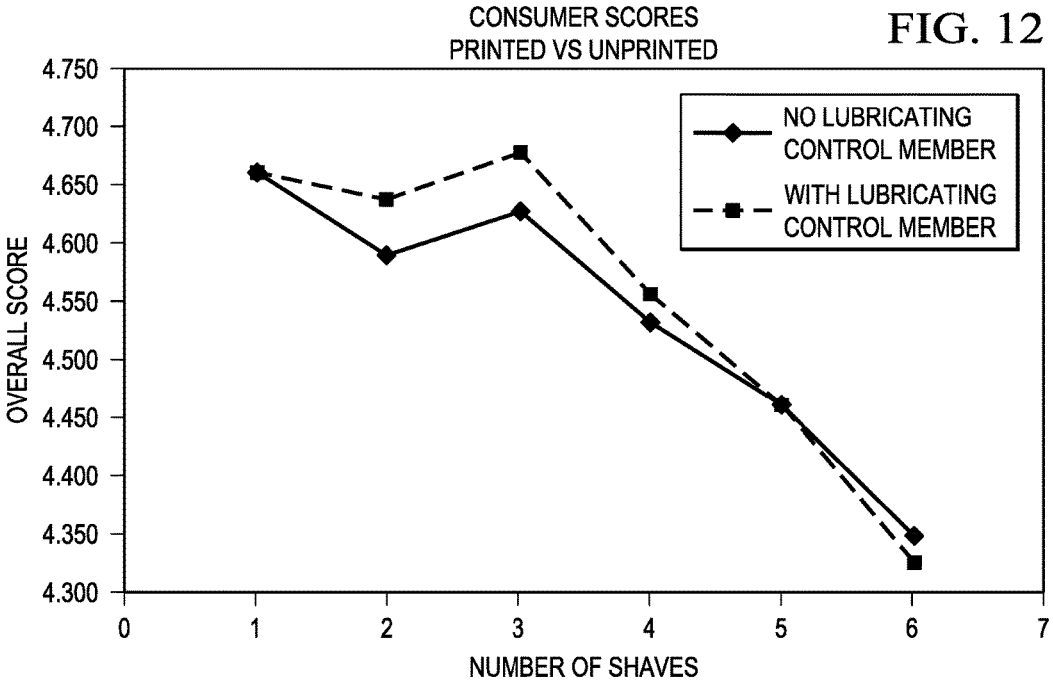
FIG. 12 is a graph showing overall consumer acceptance scores of two razor cartridges.

A cartridge with a printed control member was tested with consumers. In the test forty panelists were asked to shave with two different cartridges. Both cartridges were of the same configuration and contained the same lubricating member formula. The lubricating member contained 23.6% of a low mol wt polyethylene oxide having an average mol wt of less than 1 million to about 100,000 Da, 5.0% polyethylene glycol, 27.0% ethylene vinyl acetate with 12% vinyl acetate, 4.0% white colorant, 35.40% of a high mol wt polyethylene oxide having an average mol wt of about 2 million to 10 million Da, and 5.0% polycaprolactone. In the first cartridge the lubricating member contained no lubrication control member. In the second cartridge the lubricating member was printed with a lubrication control member similar to that shown in FIGS. 9 and 10 having open areas between the printed droplets. The lubrication control member covered 25% of the visible surface area of the lubricating member. Each panelist was asked to shave each cartridge six shaves and rate the overall performance of each shave. The results of the test are shown in FIG. 12. As can be seen, the two products performed at near parity with each other.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a razor cartridge comprising the steps of;

a. providing a razor cartridge comprising a guard at a front portion of said cartridge, a cap at a back portion of said cartridge, at least one blade positioned between said guard and said cap, a top surface, and a lubricating member positioned at said top surface, said lubricating member having a visible surface, said visible surface having a visible surface area;

b. printing a lubrication control structure directly on said visible surface of said lubricating member, said lubrication control structure comprising a UV curable ink covering a portion of said visible surface area creating a covered portion and an open portion, wherein the printed lubrication control structure comprises a plurality of individual printed droplets having a diameter of 10 microns or less with adjacent printed droplets spaced apart from one another.

2. The method of claim 1, wherein the lubricating member within the open portion is directly exposed to a user's skin during shaving.

3. The method of claim 1, wherein said lubricating member is positioned on said cap.

4. The method of claim 1, wherein said lubricating member is positioned on said guard.

5. The method of claim 1, wherein said lubricating member is a ring surrounding said blade.

6. The method of claim 1, wherein said covered portion covers from 3% to 70% of the visible surface area.

7. The method of claim 1, wherein said covered portion covers from 5% to 40% of the visible surface area.

8. The method of claim 1, wherein said covered portion covers from 10% to 30% of the visible surface area.

* * * * *